United States Patent [19]

Doyel

[11] 3,968,757

[45] July 13, 1976

[54] RUG-TUFTING DEVICE SUITABLE FOR HOME USE BY HOBYISTS

[76] Inventor: John S. Doyel, 404 W. 20th St., New York, N.Y. 10011

[22] Filed: Oct. 31, 1975

[21] Appl. No.: 627,668

[52] U.S. Cl. ..... 112/80
[51] Int. Cl.² ..... D03C 15/06
[58] Field of Search ..... 112/80, 169; 223/102, 223/104

[56] References Cited

UNITED STATES PATENTS

| | | | |
|---|---|---|---|
| 632,927 | 9/1899 | Roberts | 112/80 |
| 3,714,915 | 2/1973 | Montell et al. | 112/80 |
| 3,867,888 | 2/1975 | Morissette | 112/80 |

*Primary Examiner*—Henry S. Jaudon
*Attorney, Agent, or Firm*—Cooper, Dunham, Clark, Griffin & Moran

[57] ABSTRACT

Disclosed is a hand-operated rug-tufting device particularly suitable for home use by hobyists. The device is capable of numerous adjustments to make a variety of tufted rugs, and is inexpensively made primarily of molded plastic components.

5 Claims, 7 Drawing Figures

10
12
12a
12b
14
16
18
20
22
22a
22b
24
24a
24b
25
26
26a
26b
28
30
32
34
36a
36b
38a
38b
38c
38d
42
44
44a
44b
46a
46b
48a
48b
50a
50b
50c
50d
52
54a
54b
56a
56b

Fig. 3.
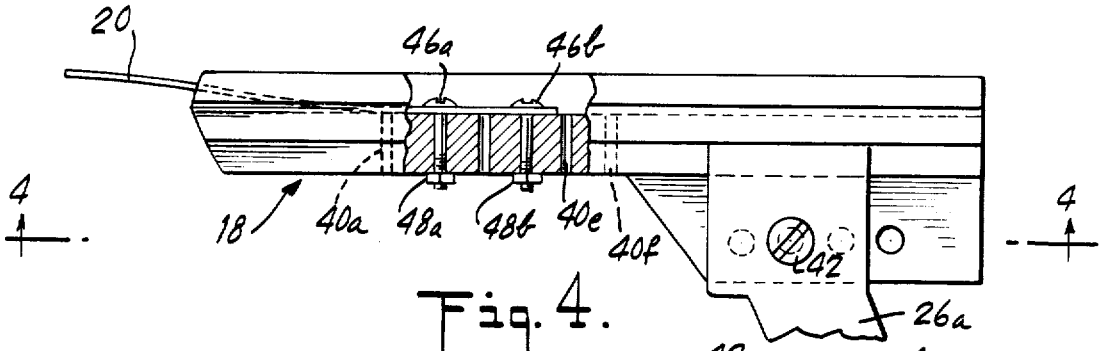
Fig. 4.
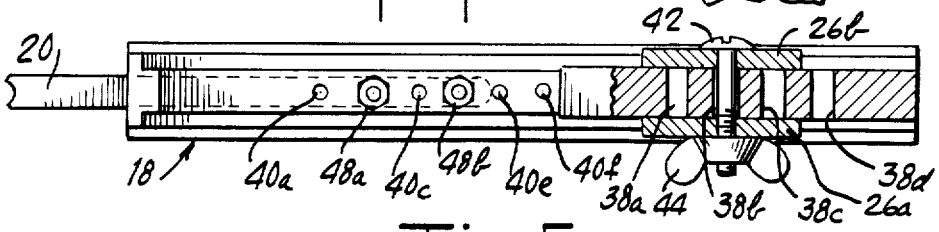
Fig. 5.
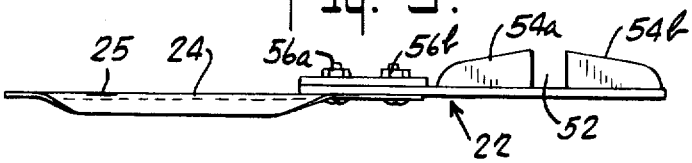
Fig. 6.
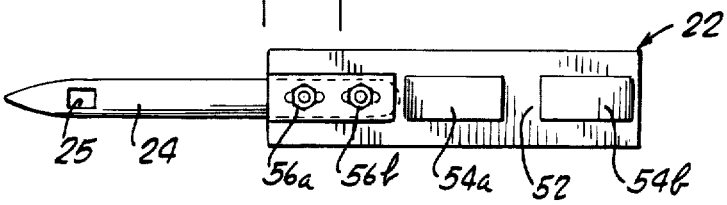
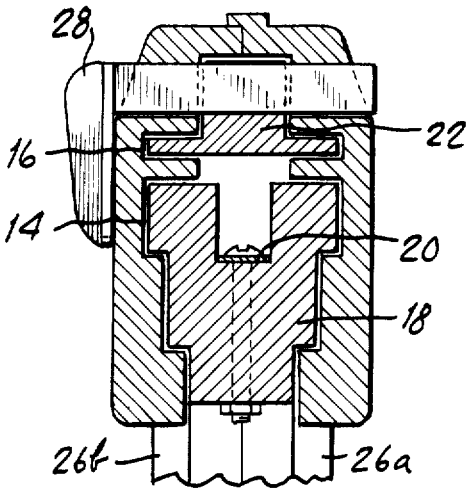
Fig. 7.

RUG-TUFTING DEVICE SUITABLE FOR HOME USE BY HOBYISTS

BACKGROUND AND SUMMARY OF THE INVENTION

The invention is in the field of hand-operated devices for making tufted rugs or similar articles, and is particularly suitable for home use by hobyists.

There are numerous prior art devices for making tufted rugs by hand, Perhaps the simplest one is a punch needle having a yarn eyelet near the sharp end. The sharp end is pushed through stretched burlap and then withdrawn to form yarn loops at the opposite side of the burlap. A punch needle of this general type, but with a spring loaded arrangement, is shown is U.S. Pat. No. 1,912,977. Other prior art rug-tufting devices use a looper in addition to the needle and operate on the principle of piercing the burlap with the needle to form a yarn loop at the opposite side of the burlap, pushing the looper through the same hole to maintain the loop while withdrawing the needle, pushing the needle through the burlap again to form an adjacent hole and pull the yarn through the new hole, withdrawing the looper from the previous hole and inserting it through the new hole to hold the new loop in place while the needle is being withdrawn, etc. There are numerous devices of this type; some are illustrated in the following U.S. Pat. Nos.: 1,614,576; 1,873,257; 1,935,915; 2,442,906 and 3,714,915. Still other rug tufting devices in the prior art do not use a looper but use instead a pressure foot similar to that of a sewing machine and work on a similar principle. Examples are shown in U.S. Pat. Nos. 889,922; 673,730; 1,932,516 and 1,937,946.

Although a number of different hand operated rug-tufting devices have been used in the past, there is still a need for a device of this general type which would be particularly easy and safe to use, which would be capable of a number of different adjustments to make a variety of rugs, and which would be inexpensive and sturdy. The invention is directed to providing a device of this type.

The rug-tufting device of this invention is almost entirely made of molded plastic components. It comprises an elongated housing, having a needle drive handle at the back end and a forward portion extending axially from the back end and having a pair of separate, parallel and axially extending slots: a looper holder slot receiving a looper holder and a needle holder slot receiving a needle holder. The two holders are received for reciprocating movement axially, along the length of the housing. A looper is secured to the looper holder and extends forwardly of the housing, and a tufting needle is secured to the needle holder and extends forwardly of the housing. A looper drive handle is secured to the looper holder to reciprocate it by moving the looper drive handle along the length of the housing. A length of yarn extends through an eye in the tufting needle.

In operation, the looper is retracted by pulling back the looper drive handle, and the needle is pushed through stretched burlap or similar material until the front of the housing is against the burlap. The looper is then pushed forward, through the same hole, to engage the loop of yarn and hold it while the needle is withdrawn. The needle is withdrawn completely from the burlap while the looper remains in place. As the needle is withdrawn and clears the burlap, it is pushed aside to point to the site of a new hole adjacent the hole where the looper is. The needle is then pushed through the burlap to form a new loop through a new hole and the looper is withdrawn from the previous hole and pushed through the new hole to hold the new loop, etc., to thereby form a row of adjacent loops in a sequence resembling walking the tufting device along the burlap.

The invented rug-tufting device is capable of numerous adjustments. The needle holder can be affixed to the housing at any one of a number of positions along the length thereof, by removing a retaining pin (by hand and without any tools) that extends transversely through a hole in the housing and a matching hole in the needle holder, moving the needle holder along the length of the housing to align the hole in the holder with another hole in the housing, and then reintroducing the retaining pin, to thereby change the distance by which the needle extends forwardly of the housing. Should even finer adjustments be needed, the device can be modified by securing to the needle holder by screws extending through elongated slots, and moving the needle along the slots with respect to the screws. Different needles can be used with the same needle holder. The distance by which the looper can extend forwardly of the housing can be similarly adjusted by changing the axial position of the looper drive handle with respect to the looper holder, and/or changing the axial position of the looper with respect to the looper holder. The looper holder has an axially extending row of holes and a retaining pin extends through one of these holes and through the looper drive handle to secure the two together. The housing has a forward stop engaging the looper drive handle in its forward motion and determining how far the looper can extend forwardly of the housing. By changing the axial position of the looper drive handle with respect to the looper holder, the distance by which the looper can extend forwardly of the housing can be changed. Moreover, the looper is attached to the looper holder by screws extending through any selected ones of a row of holes axially extending along the looper holder, again for the purpose of additional, finer adjustment of the distance by which the looper can extend forwardly of the housing. The needle drive handle is hollow and forms a needle case which can be used for a storage area for needles and the like. The needle case is closed by a lid at the back end of the needle drive handle. The axial depth of the needle holder slot corresponds to the combined length of the needle holder and the needle, whereby the device can be safely stored when the retaining pin of the needle holder is removed and the needle holder is pushed all the way back into the housing for a maximum retraction of the needle.

BRIEF DESCRIPTION OF THE DRAWINGS

FIG. 3 is a side elevational view of a looper holder and a partial view of a looper drive handle forming a part of the device shown in FIGS. 1 and 2.

FIG. 4 is a view taken along line 4—4 of FIG. 3.

FIG. 5 is a side elevational view of a needle holder forming a part of the device shown in FIGS. 1 and 2.

FIG. 6 is a top elevational view of the needle holder.

FIG. 7 is a sectional view taken along line 7—7 of FIG. 1.

DETAILED DESCRIPTION

Figures 1, 2:
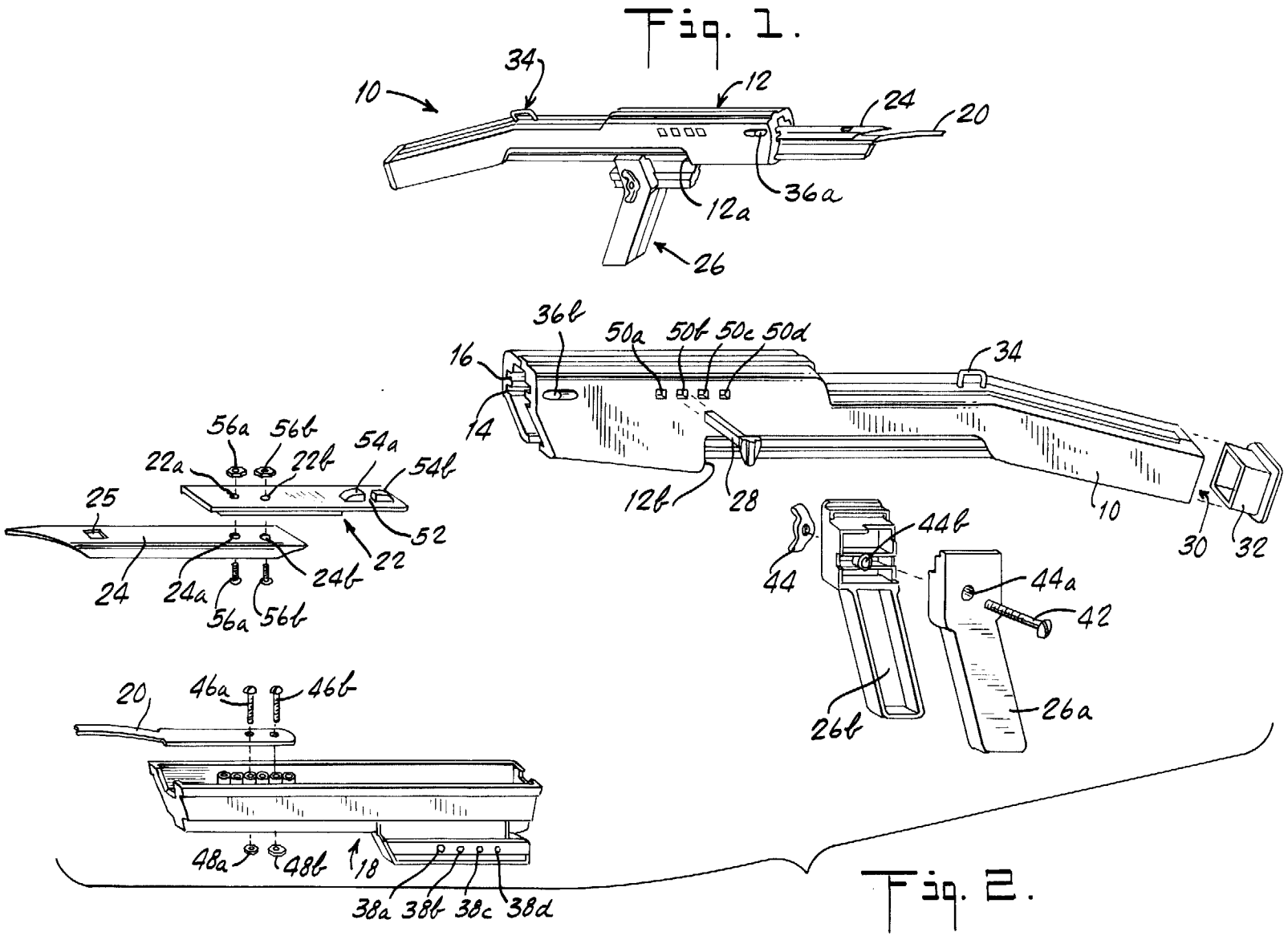
FIG. 1 is a perspective view of an embodiment of the invented device.
FIG. 2 is a perspective exploded view of the device from a side opposite that shown in FIG. 1.

Referring to FIGS. 1, 2 and 7 the invented hand-operated rug-tufting device comprises an axially extending, elongated housing formed of molded plastic components and having a needle drive handle 10 at the back end and a forward portion generally indicated at 12 and extending axially forwardly of the needle drive handle 10. The forward portion 12 is substantially hollow and channel shaped and defines an axially extending looper holder slot 14 and an elongated axially extending needle holder slot 16. The slot 14 receives slidably a looper holer 18 having a looper 20 secured thereto. The slot 16 receives slidably a needle holder 22 having a needle 24 secured thereto. A looper drive handle 26 is secured to the back portion of the looper holder to reciprocate the looper holder axially within the looper holder slot of the housing. The needle holder is secured at a fixed position with respect to the housing by a needle lock 28. The needle drive handle 10 is hollow, to define a needle case 30 whose open back end is closed by a lid 32. Yarn or fabric strips are fed from the rear of the device through a top yarn guide 34, through one of two lower yarn guides **36*a* and 36*b* (one on each side of the housing), and through a needle yarn hole 38**.

Referring to FIGS. 2, 3 and 4, the looper holder 18 is an integrally molded plastic component having an axially extending row of transverse holes **38*a* through 38*d* through a downwardly extending projection from its back end, and an axially extending row of transverse holes 40*a*–40*f* through its forward end. The looper drive handle 26 can be secured to the looper holder 18 at a selected axial position with respect thereto by means of a looper adjustment screw 42 passing through suitable holes 44*a* and 44*b* in the parts 26*a* and 26*b* making up the looper drive handle 26 and passing through a selected one of the holes 38*a*–38*d*. A wing nut 44 is used to tighten the looper adjustment screw 42. When the looper drive handle is attached to the looper drive, the extent of the axial movement of the assembly is limited on the back when the back end of the looper A–comes against a suitable stop (not visible) of the housing, and in the forward direction when the leading edges of the upper ends of the portions 26*a* and 26*b* of the handle 26 strike the forward stops 12*a* and 12*b* of the housing. It should be clear that while the extent of the back movement of the looper holder is fixed, the extent of its forward movement can be varied by passing the looper adjustment screw 42 through a different one of the holes 38*a* 38*d*. The looper 20 is secured to the looper holder 18 by looper screws 46*a* and 46*b* extending through respective holes 20*a* and 20*b* at the back end of the looper, and also extending through selected two of the holes 40*a*–40*f* in the looper holder. Looper nuts 48*a* and 48*b* tighten the screws 46*a* and 46*b*. Again, it is clear that the maximum distance by which the looper can protrude from the forward end of the looper holder can be varied by passing the looper screws 46*a* and 46*b* through different ones of the holes 40*a*–40*f*** of the looper holder.

Referring to FIGS. 2, 5 and 6, the needle holder 22 is secured to the housing at a selected axial position with respect thereto by a needle lock 28 passing through a selected one of an axially extending row of holes **50*a*–50*d* in the housing and through a slot 52 formed between two projections 54*a* and 54*b*, axially spaced from each other and extending upwardly from the body of the needle holder 22. The needle 24 is secured to the needle holder 22 by a pair of needle screws 56*a* and 56*b* passing through respective holes 24*a* and 24*b* at the back end of the needle and 22*a* and 22*b* at the forward end of the needle holder and secured by needle nuts 56*a* and 56*b*. Again, it should be clear that the distance by which the needle protrudes from the housing can be varied by passing the needle lock 28 through a different one of the holes 50*a*–50*d***.

In operation, a sheet of a material such as burlap is stretched, such as on a frame of the type disclosed in applicants copending application Ser. No. 587,280, filed on June 16, 1975, and the leading end of a string of yarn is passed through the top yarn guide 34, the lower yarn guide 36, and the needle yarn hole 25. Instead of yarn, fabric strips may be used, cut with a device such as disclosed in the copending application of this applicant Ser. No. 606,777, filed on Aug. 22, 1975. These two copending application of this applicant are hereby incorporated by reference as though fully set forth herein. With the disclosed rug tufting device loaded with yarn or a fabric strip as detailed above, and with the leading end of the yarn or strip protruding several inches from the needle, the device is held vertically, or nearly vertically, with respect to the burlap, with the looper retracted all the way in to the housing, and the needle is pushed through the burlap until the forward end of the housing comes against the burlap. While the device is held in this position, the looper drive handle is pushed forward so that the looper holds the newly formed loop. With the looper held in that position, the needle is raised all the way out of the burlap, and is pushed again through the burlap at an adjacent point. With the needle held down, the looper is raised all the way out of the burlap and is then pushed again through the new hole to hold the newly formed loop. This action is continued by moving the needle drive handle and the looper drive handle alternately up and down. The length of the loops is determined by how far the looper goes into the burlap. The looper should slide a small distance away from the needle, for example 1/16 of an inch. The angle of the device with respect to the burlap determines the space between loops. The more straight up and down the device is, the shorter the space between loops. When the device is at an angle with respect to the burlap, it moves toward new loops in the direction away from the direction in which the device is leaning.

The device may have interchangeable needles for different types of tufting. If finer adjustment of the distance by which the needle can protrude from the housing is desired, the holes **22*a* and 22*b*, or the holes 24*a* and 24*b***, or all four may be elongated in the axial direction, or may be replaced by an axial slot in one or both of the needle and the needle holder so that the needle and the needle holder can be secured at any selected relative position axially within a certain range. The same is true for the looper and the looper holder. However, if it is not needed to adjust the relative axial position of the needle with respect to the needle holder or of the looper with respect to the looper holder, the needle or the looper or both of them may be permanently secured to their holders.

One of the advantages of the invented device is that most of its parts are inexpensively made of molded plastic components. Another advantage is that it is very light, for ease of operation, and yet very sturdy because of its inherent strength as a walled, hollow structure rather than a solid one. Still another advantage of the invented device relates to its capability of numerous adjustments. Still another advantage is the convenience of the needle case at the needle drive handle.

I claim:

1. A hand-operated rug-tufting device comprising:

an axially extending elongated, and substantially hollow housing having a needle drive handle at the axially back end and a forward portion having a forwardly opening and axially extending looper holder slot and a forwardly opening and axially extending needle holder slot;

an elongated, axially extending looper holder received within the looper holder slot of the housing for reciprocating axial movement therein with respect to the housing;

an elongated, axially extending looper secured to the looper holder at a selected axial position with respect thereto and extending forwardly of the axially forward end of the looper holder;

a looper drive handle secured to the axially back end of the looper holder at a selected axial position with respect thereto and extending transversely away from the housing;

an elongated, axially extending needle holder received within the needle holder slot of the housing for axial movement therein with respect to the housing;

means for securing the needle holder to the housing at a selected axial position with respect thereto;

an elongated, axially extending needle secured to the needle holder and extending axially forwardly therefrom; and said housing having a back stop and a forward stop disposed in the reciprocating axial path of the combination of the looper holder and the looper drive handle to limit the respective forward and back movement of said combination.

2. A device as in claim 1 wherein the means securing the needle holder to the housing comprise an axially extending row of first openings in one of the needle holders and the housing and at least one matching second opening in the other, said second opening successively registering with different first openings as the needle holder is moved axially with respect to the housing within the needle holder slot, each opening extending transversely of the axial length of the housing, and a needle lock extending through and engaging a selected first opening and said second opening to secure the needle holder to the housing at said selected axial position with respect thereto.

3. A device as in claim 2 wherein the means securing the looper drive handle to the looper holder comprise an axially extending row of third openings in one of the looper drive handle and the looper holder, and at least one matching fourth opening in the other, said fourth opening successively registering with different third openings as the looper drive handle and the looper holder are moved axially with respect to each other, each of said third and fourth openings extending transversely of the axial length of the housing, and a retainer fastener extending through and engaging a selected third opening and said fourth opening to secure the looper drive handle and the looper holder at said selected axial position with respect to each other.

4. A device as in claim 1 wherein the axial length of the needle holder slot corresponds to the combined axial length of the needle holder and the needle, whereby the needle lock may be removed and the needle retracted into the housing for safe storage of the device.

5. A device as in claim 1 wherein the needle drive handle includes means defining a needle case chamber extending axially within the needle drive handle for storing spare needles and the like, said needle case chamber being open at the back end of the needle drive handle, and including a removable lid for closing said open back end of the needle case chamber.

* * * * *